US006244924B1

(12) United States Patent
Liu

(10) Patent No.: US 6,244,924 B1
(45) Date of Patent: Jun. 12, 2001

(54) MOTION TOY WITH ARTICULATED LEGS AND HEAD

(75) Inventor: Kun-Hsin Liu, Taipei (TW)

(73) Assignee: Chain Fong Toys Co., Ltd., Taipei Hsien (TW)

( * ) Notice: Subject to any disclaimer, the term of this patent is extended or adjusted under 35 U.S.C. 154(b) by 0 days.

(21) Appl. No.: 09/559,421

(22) Filed: Apr. 27, 2000

(30) Foreign Application Priority Data

Dec. 9, 1999 (TW) ..... 88220996

(51) Int. Cl.[7] ..... A63H 11/00
(52) U.S. Cl. ..... 446/352; 446/330; 40/420
(58) Field of Search ..... 446/268, 297, 446/298, 300, 303, 308, 309, 312, 330, 352, 356; 40/411, 418, 420

(56) References Cited

U.S. PATENT DOCUMENTS 2,467,040 * 4/1949 King ..... 40/418
3,060,631 * 10/1962 Collischan ..... 446/303 X
4,095,367 * 6/1978 Ogawa ..... 446/308 X
4,795,395 * 1/1989 Oishi et al. ..... 446/303 X
5,147,238 * 9/1992 Kelley et al. ..... 446/268 X
5,735,726 * 4/1998 Cohen ..... 446/298
6,012,962 * 1/2000 Arriola ..... 446/330 X

* cited by examiner

*Primary Examiner*—Sam Rimell
(74) *Attorney, Agent, or Firm*—Bacon & Thomas

(57) ABSTRACT

A motion toy includes a toy body, the toy body having a hollow trunk, a head pivoted to the trunk at a top side, and two legs respectively pivoted to the trunk at two opposite sides, the legs each having a thigh pivoted to the trunk, a foot, and a calf pivotally coupled between the thigh and the foot, a power drive unit formed of a DC motor and gear transmission means and installed in the trunk of the toy body and controlled to turn the thighs of the legs alternatively back and forth and the calves of the legs alternatively up and down, and a battery box installed in the trunk to provide battery power supply to the DC motor.

15 Claims, 10 Drawing Sheets

MOTION TOY WITH ARTICULATED LEGS AND HEAD

BACKGROUND OF THE INVENTION

The present invention relates to toys, and more particularly to a motion toy, which comprises a toy body, and a power drive installed in the trunk of the toy body and controlled to move the head and legs of the toy body.

A variety of motion toys are commercially available. These motion toys commonly use battery to move a motor drive mechanism, causing the motor drive mechanism to move moving parts of the toys. FIGS. 8 and 9 illustrate a motion toy duck according to the prior art. This structure of motion toy duck comprises a body A shaped like a duck, and a power drive unit B installed in the body A. The body A comprises a trunk Al, a head A2 coupled to the trunk A1 at the top, two wings A3 coupled to the trunk A1 at two opposite lateral sides, a tail A5 coupled to the trunk A1 at the rear side, and two legs A4 bilaterally coupled to the trunk A1 at the bottom side. The power drive unit B comprises an on/off switch B1, a transmission gear mechanism B2, a DC motor (not shown) controlled by the on/off switch B1 to turn the transmission gear mechanism B2, causing the transmission gear mechanism B2 to move the head A2, the wings A3 and the tail A5, link means B4, and a rotary wheel B3 rotated by the transmission gear mechanism B2 to move the link means B4 back and forth. When the link means B4 is moved downwards, it lifts the body A forwardly upwards. When the link means B4 is moved upwards, the legs A4 are lowered to the floor. Continuously moving the link means B4 causes the body A to be moved forwards. This regular motion is monotonous and less attractive.

SUMMARY OF THE INVENTION

According to one aspect of the present invention, the motion toy comprises a toy body, the toy body having a hollow trunk, a head pivoted to the trunk at a top side, and two legs respectively pivoted to the trunk at two opposite sides, the legs each having a thigh pivoted to the trunk, a foot, and a calf pivotally coupled between the thigh and the foot, a power drive unit formed of a DC motor and gear transmission means and installed in the trunk of the toy body and controlled to turn the thighs of the legs alternatively back and forth and the calves of the legs alternatively up and down, and a battery box installed in the trunk to provide battery power supply to the DC motor. According to another aspect of the present invention, the legs of the toy body each comprise a thigh pivoted to the trunk of the toy body, a foot, a calf pivotally coupled between the thigh and the foot, and a torsional spring-supported link installed in the thigh, the torsional spring-supported link having a top end extended out of the thigh and coupled to a respective arched sliding slot on the trunk and a bottom end connected to the calf for enabling the calf to be turned up and down by the power drive unit. According to still another aspect of the present invention, the head comprises a horizontal bottom pivot inserted into a top through hole on the trunk of the toy body and pivoted to an axle housing at the power drive unit; the power drive unit comprises a cam wheel rotated by the transmission gear means, and a rocker coupled between the cam wheel and the horizontal bottom pivot and driven by the cam wheel to move the horizontal bottom pivot and the head back and forth.

DETAILED DESCRIPTION OF THE PREFERRED EMBODIMENT

Figure 1:
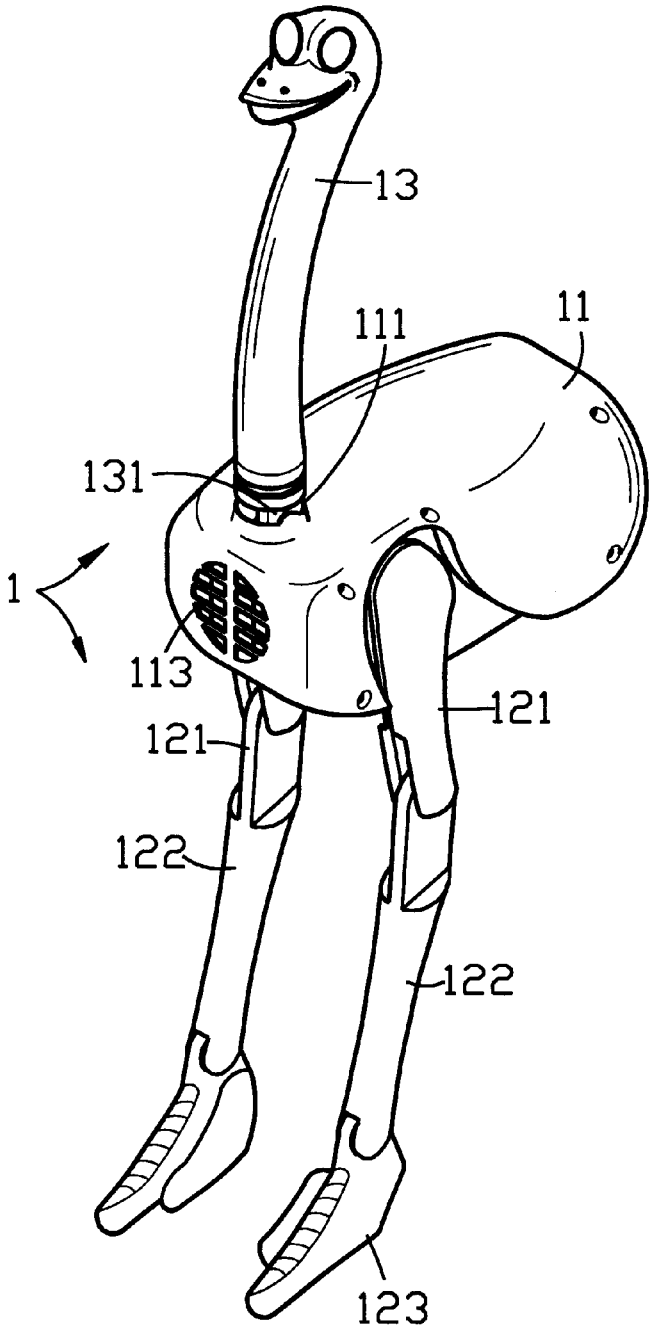
FIG. 1 is an elevational view of a motion toy according to the present invention.

Referring to FIGS. from 1 through 3, a motion toy in accordance with the present invention is generally comprised of a toy body 1, a power drive unit 2, and a bottom cover 3.

The toy body 1 is comprised of a trunk 11, two legs 12, and a head 13. The trunk 11 is a hollow, bottom-open shell comprising a top through hole 111 disposed near the front side thereof, two arched sliding slots 1131 respectively formed on two opposite lateral side walls thereof, two axle holes 112 respectively disposed in the two opposite lateral side walls adjacent to the arched sliding slots 1131, two through holes 1121 respectively disposed in the two opposite lateral side walls adjacent to the axle holes 112 a, and a grille 113 disposed at the front side. The legs 12 are respectively pivoted to the axle holes 112 on the trunk 11, each comprising a thigh 121, a calf 52, a foot 123, a torsional spring 124 and a link 125 mounted in the thigh 121, and a coupling member 128 coupled between the thigh 121 and one axle hole 112 of the trunk 11. The thigh 121 has a top pivot hole 127 pivoted to the trunk 11, a bottom pivot hole 126 pivoted to one end, namely, the top end of the corresponding calf 122 by a respective pivot 4. A respective pivot 4 pivots the bottom end of the calf 122 to the foot 123. The head 13 has a horizontal bottom pivot 131 inserted into the top through hole 111 on the trunk 11 and pivoted to the power drive unit 2.

Figure 3:
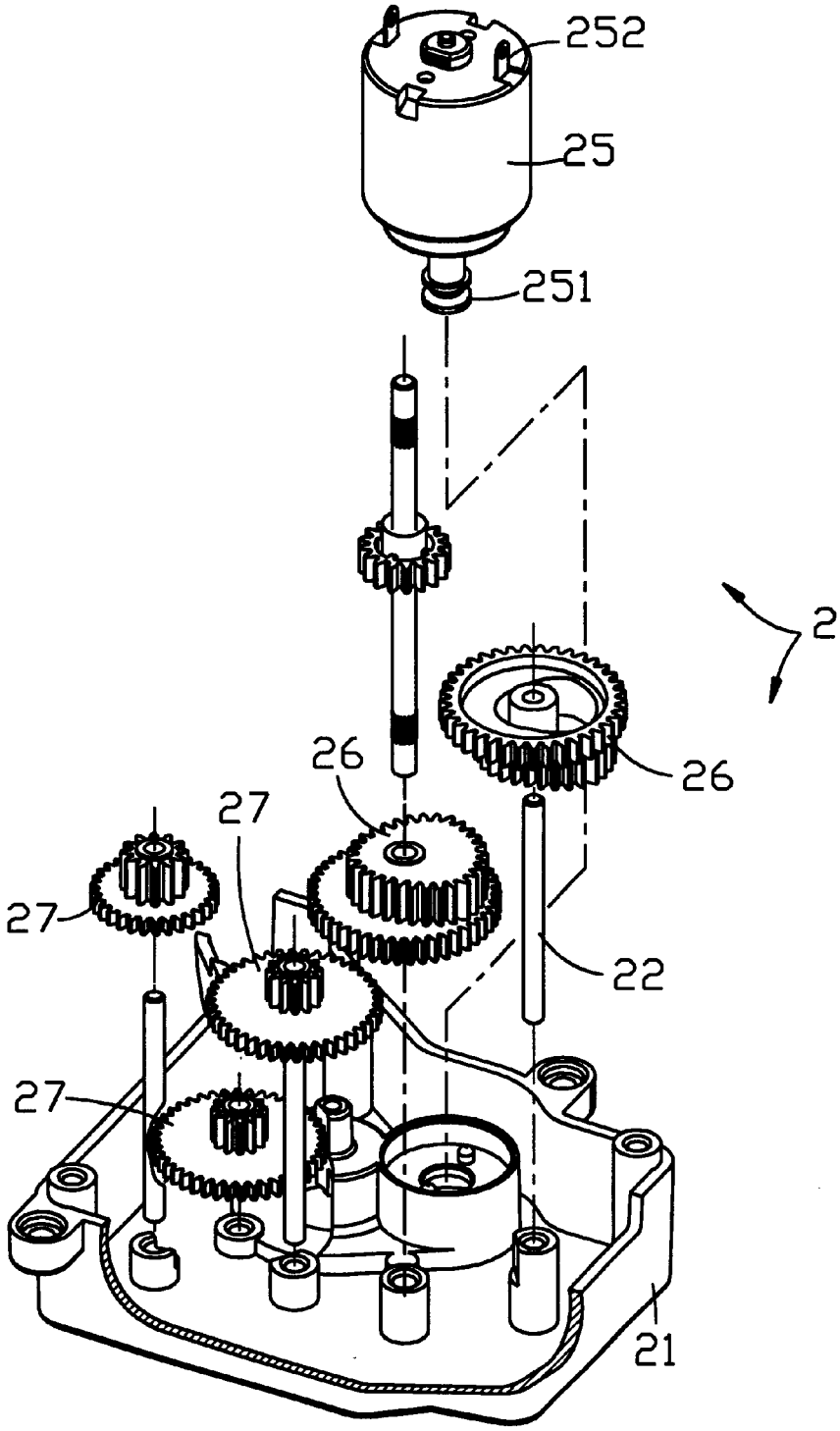
FIG. 3 is an exploded view of the power drive unit for the motion toy according to the present invention.
Figure 3A:
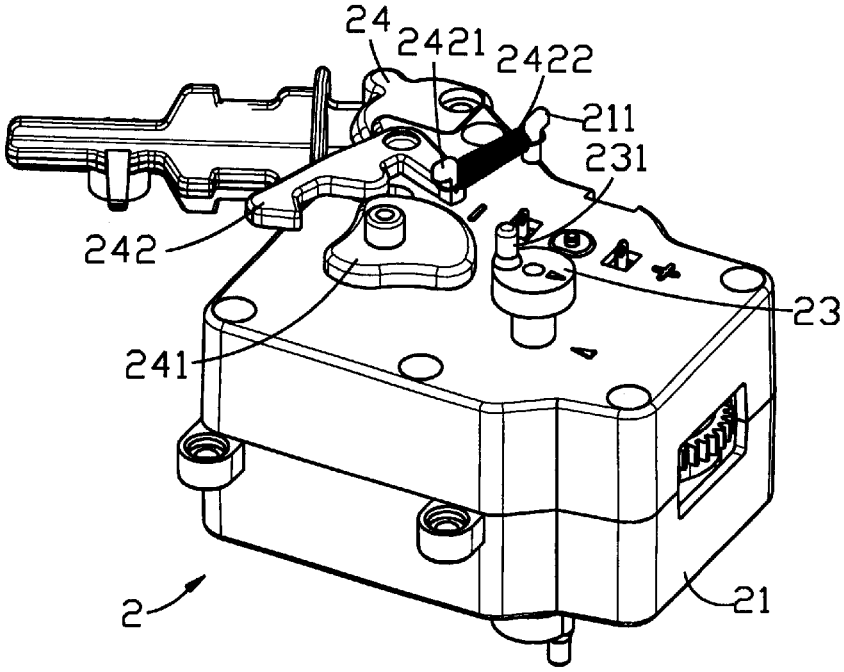
FIG. 3A is an elevational view of the power drive unit for the motion toy according to the present invention.
Figure 3B:
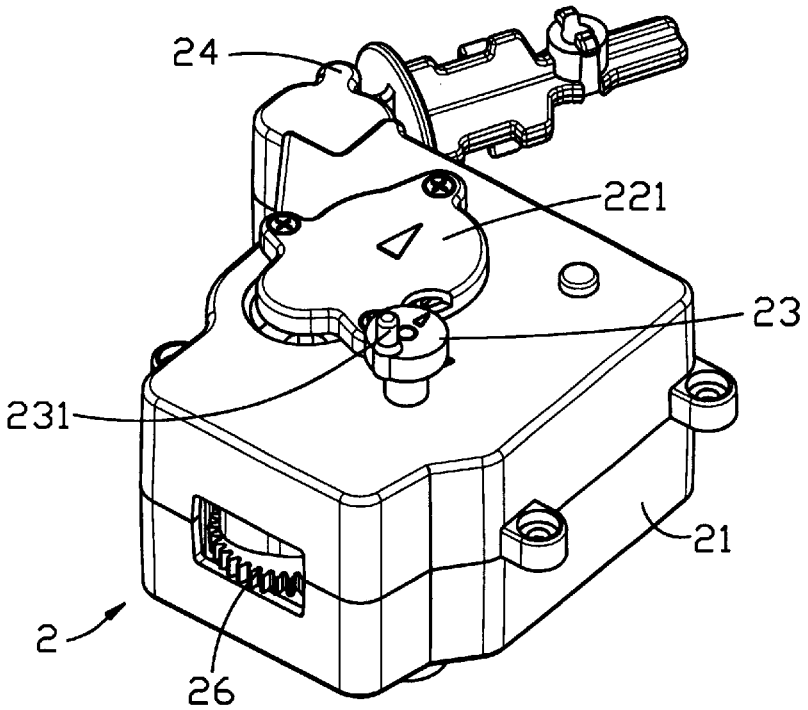
FIG. 3B is another elevational view of the power drive unit for the motion toy according to the present invention when viewed from another side.
Figure 4:
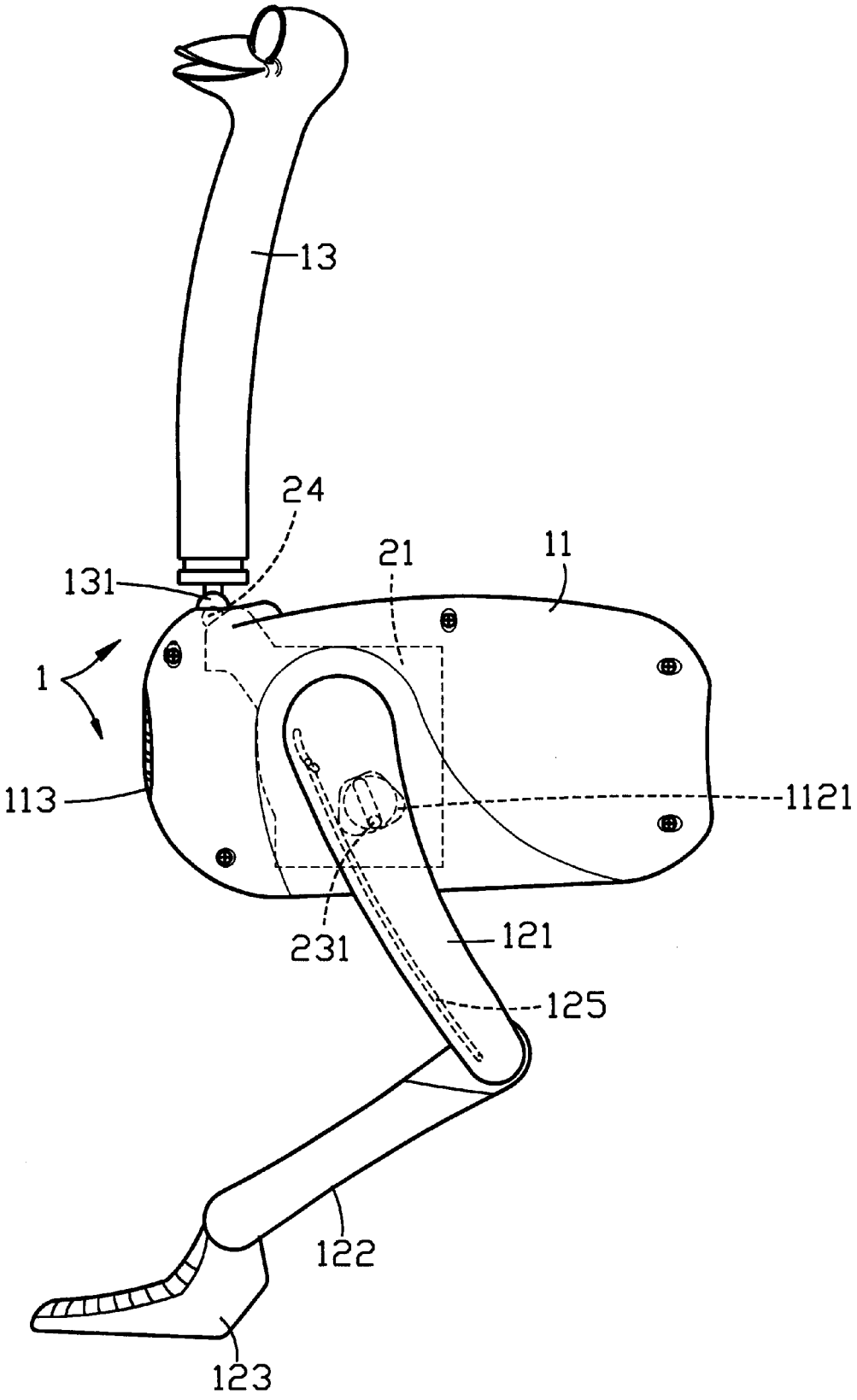
FIG. 4 is a side view of the motion toy according to the present invention.
Figure 5:
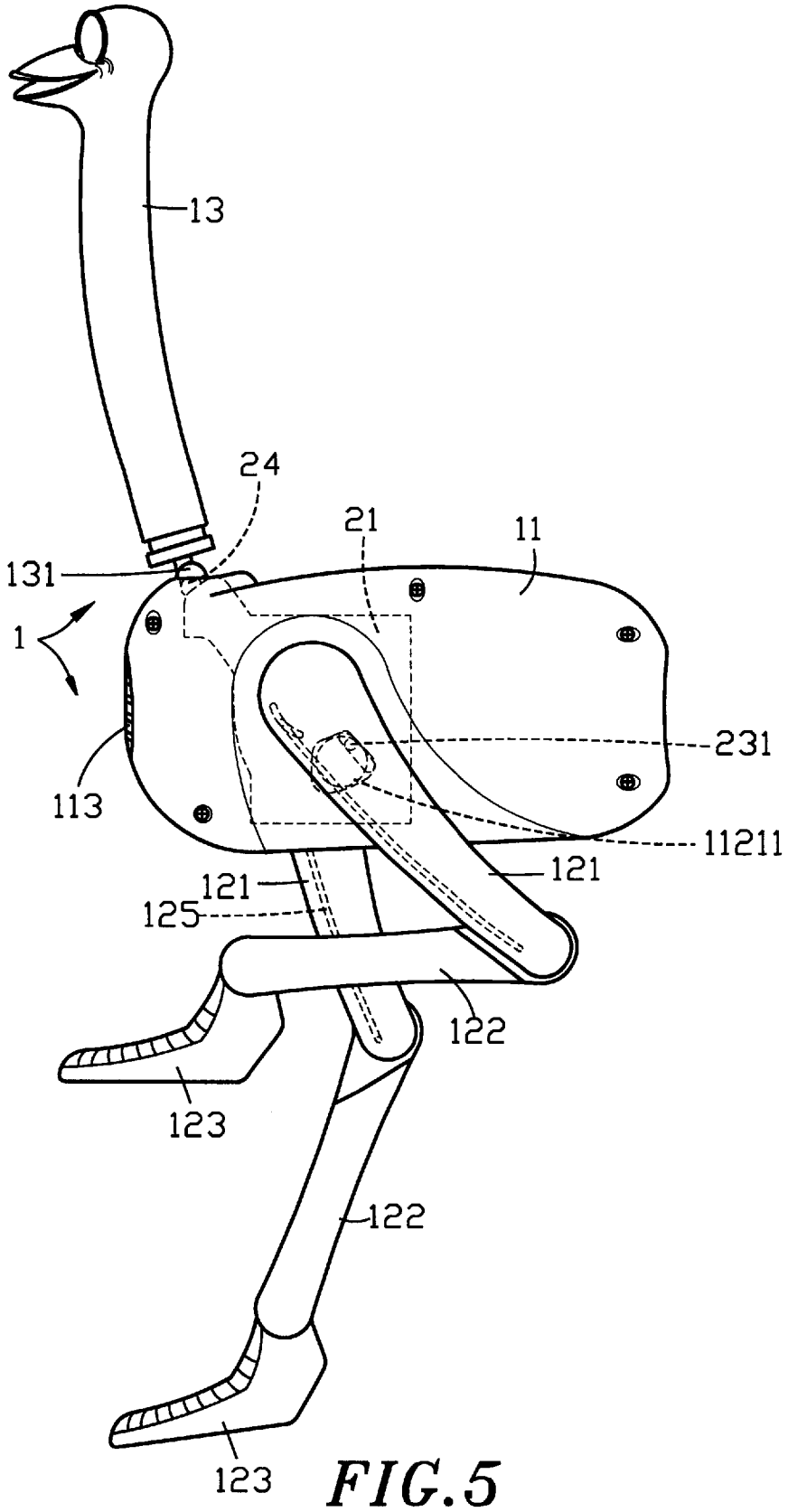
FIG. 5 illustrates the motion toy operated, the left leg lifted, the right leg lowered according to the present invention.
Figure 6:
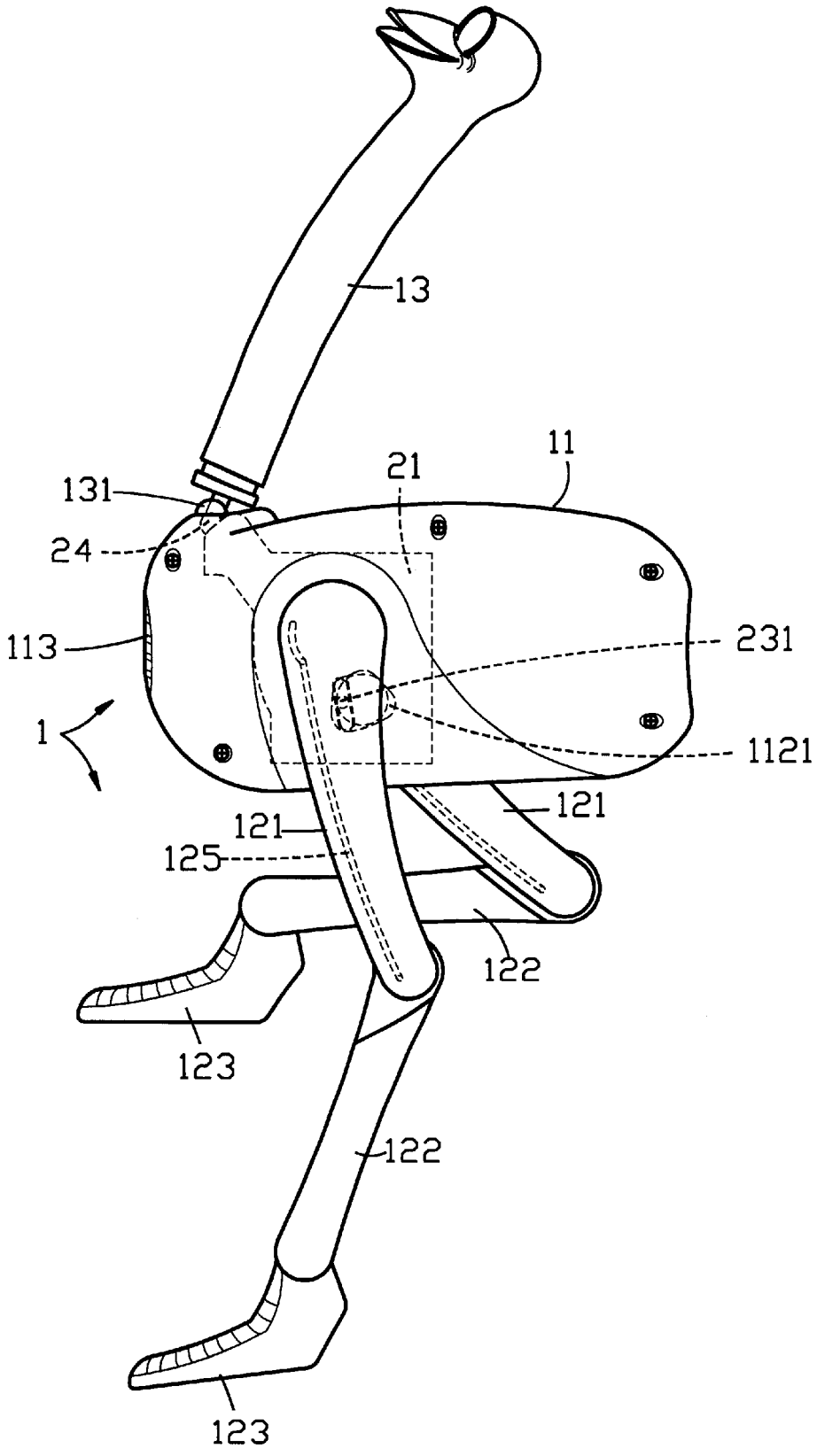
FIG. 6 illustrates the motion toy operated, the left leg lowered, the right leg lifted according to the present invention.

Referring to FIGS. 3A and 3B and FIG. 3 again, the power drive 2 comprises two symmetrical cover shells 21, a hanging rod 211 disposed outside the cover shells 21 adjacent to the head 13, a DC motor 25 mounted inside the cover shells 21, the DC motor 25 having power input terminals 252 for battery power input, a first belt wheel 251 fixedly mounted on the output shaft of the DC motor 25 and disposed outside the cover shells 21, a transmission shaft 22, a second belt wheel (not shown) fixedly mounted on one end of the transmission shaft 22 and disposed outside the cover shells 21, a transmission belt (not shown) coupled between the first belt wheel 251 and the second belt wheel outside the cover shells 21, a shield 221 fastened to one cover shell 21 and covered over the second belt wheel and the transmission belt, transmission gears 26 and 27 meshed with one another and coupled to the transmission shaft 22, two rotary wheels 23 respectively disposed outside the cover shells 21, the rotary wheels 23 each having an eccentric shaft 231 respectively extended out of the through holes 1121 on the trunk 11 and coupled to the coupling members 128, an axle housing 24 disposed outside the cover shells 21 and coupled to the horizontal bottom pivot 131 of the head 13, a cam wheel 241 disposed adjacent to the axle housing 24, a rocker 242 pivoted to one cover shell 21 and meshed with the cam wheel 241, and a spring 2442 connected between a hanging portion 2421 at one end of the rocker 242 and the hanging rod 211.

Figure 2:
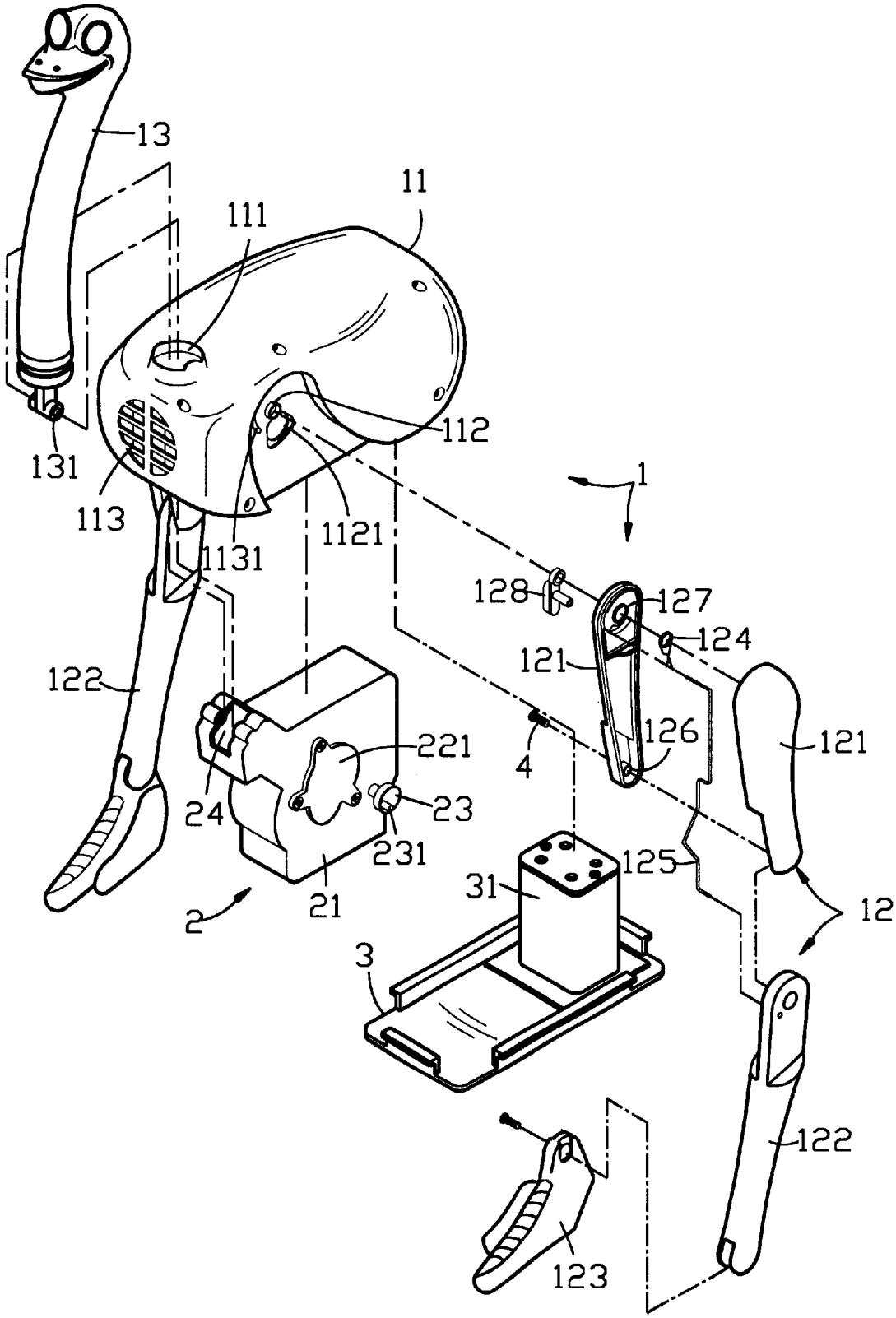
FIG. 2 is an exploded view of the motion toy shown in FIG. 1.

Referring to FIG. 2 again, the bottom cover 3 is covered on the bottom open side of the trunk 11, and holds a battery box 31.

Referring to FIGS. from 1 through 3 again, the power drive unit 2, the battery box 31, a music producing means (not shown) and the bottom cover 3 are respectively installed in the trunk 11, permitting the horizontal bottom pivot 131 of the head 13 to be pivoted to the axle housing 24 of the power drive unit 2, and the power input terminals 252 of the DC motor 25 to be connected to the power output terminals of the battery box 31 at the bottom cover 3. The link 125 of each leg 12 has a top end extended out of the respective thigh 121 and coupled to one arched sliding slot 1131 on the trunk 11, and a bottom end connected to the top end of the respective calf 122. The top pivot hole 127 of the thigh 121 of each leg 12 and the corresponding coupling member 128 are pivoted to one axle hole 112 on the trunk 11. The thigh 121 of each leg 12 further comprises a side rod (not shown) coupled to one through hole 1121 on the trunk 11. The torsional spring 124 of each leg 12 is mounted in the respective thigh 121 and pressed on the corresponding link 125.

Referring to FIGS. from 4 through 6, and FIGS. from 1 through 3B again, when the DC motor 25 of the power drive unit 2 is started, the first belt wheel 251 is driven to rotate the second belt wheel via the transmission belt, causing the transmission shaft 22 and the transmission gears 26 and 27 to be rotated, and therefore the cam wheel 241 and the rotary wheels 23 are driven by the transmission gears 26 and 27 to move the legs 12. When the cam wheel 241 is rotated, the head 13 is forced to move back and forth. During movement of the head 13, the links 125 are driven by the eccentric shafts 231 of the rotary wheels 23 to move the legs 12, causing the legs 12 to simulate a walking motion. When the eccentric shaft 231 is rotated with the respective rotary wheel 23 through one run, the thigh 121 of the corresponding leg 12 is turned backwards through a fixed angle from a vertical position to a sloping position and then returned from the sloping position to the vertical position, and at the same time the link 125 is moved in the arched sliding slot 1131 between two distal ends through one cycle to lift and then lower the corresponding calf 122. During movement of the calf 122, the corresponding foot 123 is maintained in horizontal. Continuously rotating the DC motor 25 causes the motion toy to simulate the walking motion of an animal. Further, during movement of the head 13 and legs 12 of the toy body 1, the music producing means is driven to producing tunes in matching with the motion of the toy body 1.

Figure 7:
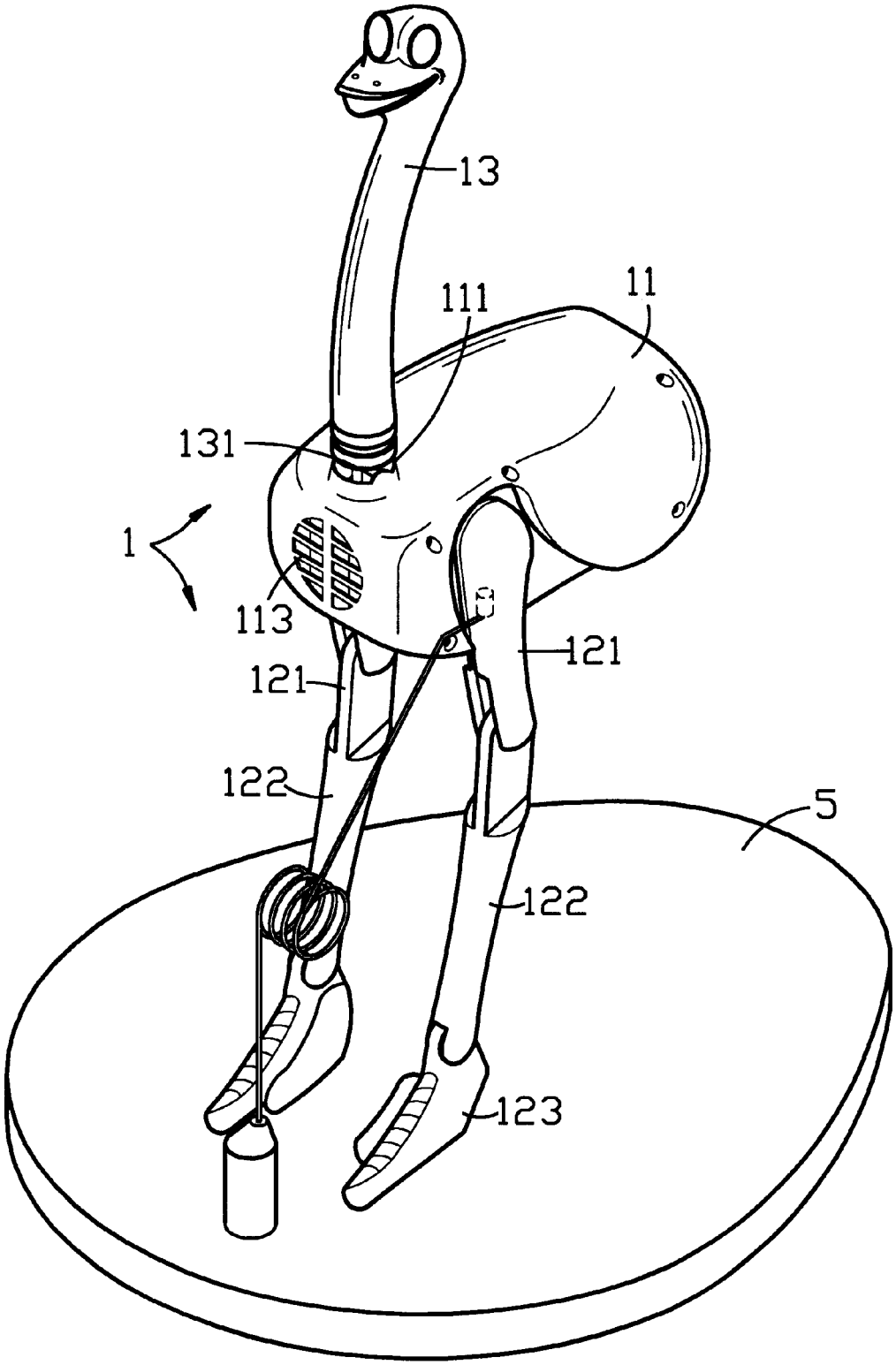
FIG. 7 illustrates the trunk of the toy body of the motion toy supported above a base according to the present invention.
Figure 8:
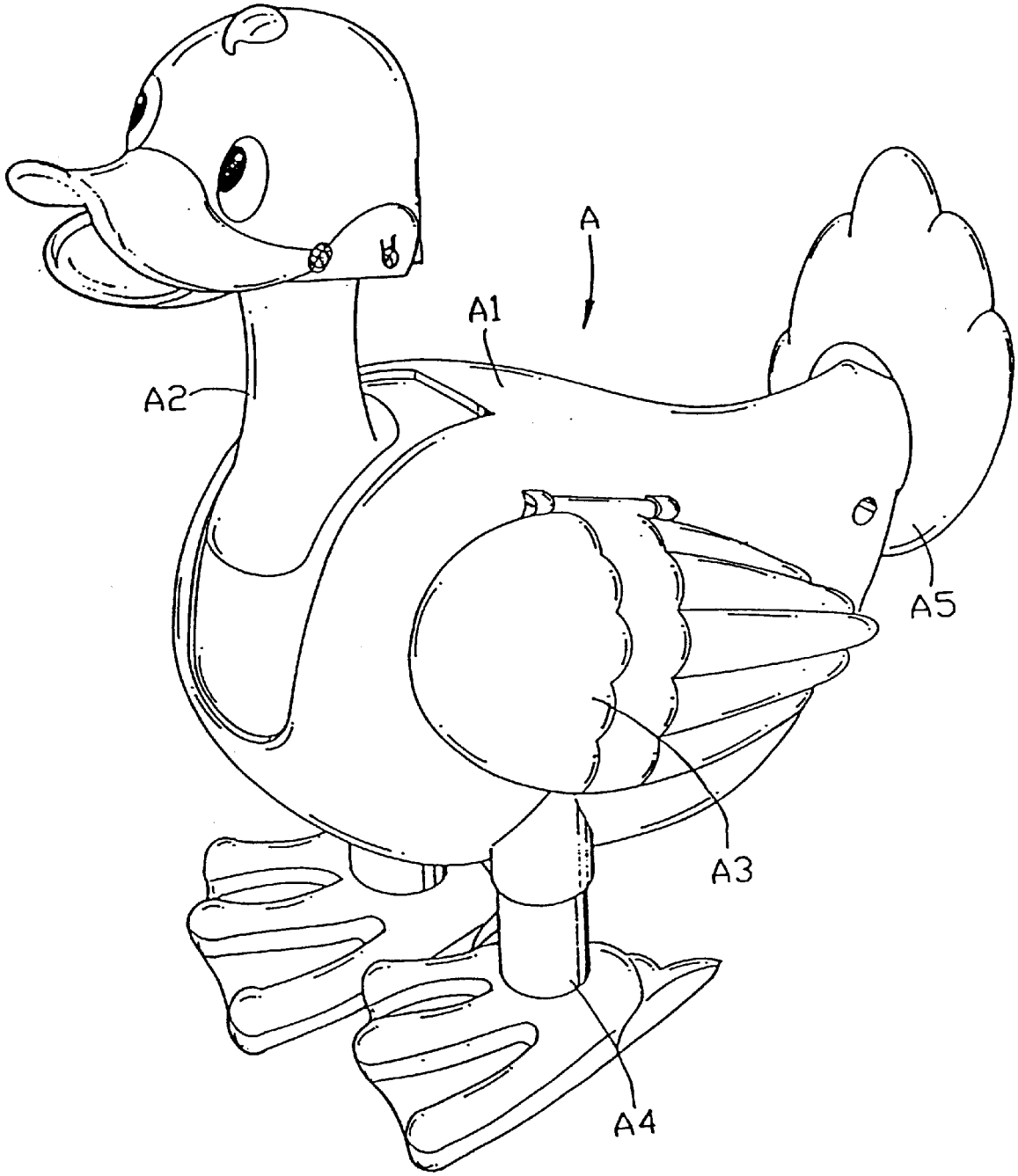
PRIOR ART FIG. 8
FIG. 8 is an elevational view of a motion toy duck according to the prior art.
Figure 9:
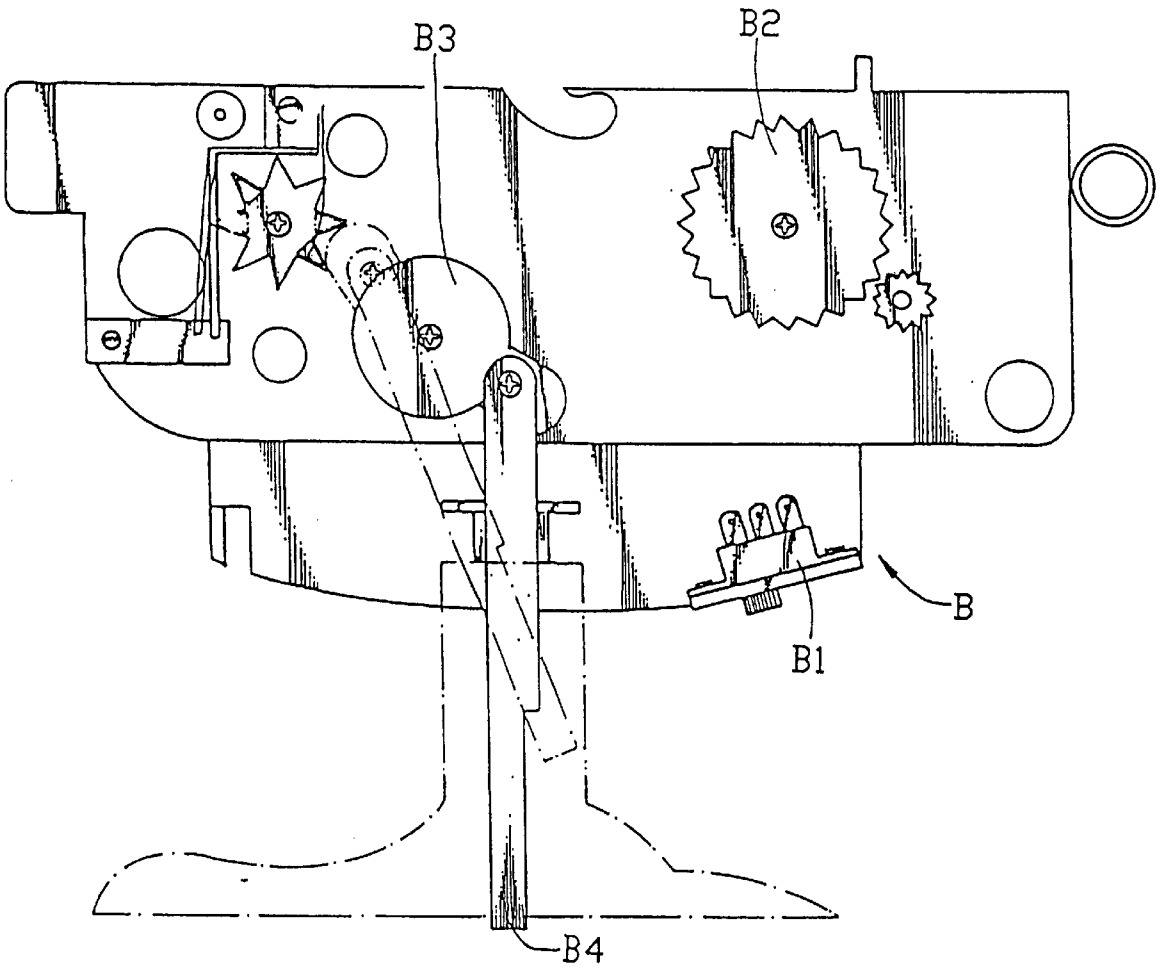
PRIOR ART FIG. 9
FIG. 9 is a sectional side view of the power drive unit for the motion toy duck shown in FIG. 8.

Referring to FIG. 7, the trunk 11 of the toy body 1 of the motion toy is supported above a base 5. When the power drive unit is started, the head 13 is moved back and forth, the thighs 121 of the legs 12 are alternatively turned back and forth, and at the same time the calves 122 of the legs 12 are alternatively lifted and lowered.

While only one embodiment of the present invention has been shown and described, it will be understood that various modifications and changes could be made thereunto without departing from the spirit and scope of the invention disclosed.

What the invention claimed is:

1. A motion toy comprising:

a toy body, said toy body comprising a hollow trunk, a head pivoted to said trunk at a top side, and two legs respectively pivoted to said trunk at two opposite sides, said legs each comprising a thigh having a top end pivoted to said trunk and a bottom end, a calf having a top end pivoted to the bottom end of said thigh and a bottom end, and a foot pivoted to the bottom end of said calf; and a power drive unit installed in said trunk and controlled in turn the thighs of said legs alternatively back and forth and the calves of said legs alternatively up and down, wherein said head comprises a horizontal bottom pivot inserted into a top through hole on said trunk and pivoted to an axle housing at said power drive unit; said power drive unit further comprises a cam wheel rotated by said transmission gear means, and a rocker coupled between said cam wheel and said horizontal bottom pivot and driven by said cam wheel to move said horizontal bottom pivot and said head back and forth.

2. A motion toy comprising:

a toy body, said toy body comprising a hollow trunk, a head pivoted to said trunk at a top side, and two legs respectively pivoted to said trunk at two opposite sides, said legs each comprising a thigh having a top end pivoted to said trunk and a bottom end, a calf having a top end pivoted to the bottom end of said thigh and a bottom end, and a foot pivoted to the bottom end of said calf; and a power drive unit installed in said trunk and controlled in turn the thighs of said legs alternatively back and forth and the calves of said legs alternatively up and down, wherein said legs each comprise a torsional spring-supported link installed in the respective thigh, said torsional spring-supported link having a top end extended out of the respective thigh and coupled to a respective arched sliding slot on said trunk and a bottom end connected to the respective calf for enabling the respective calf to be turned up and down.

3. A motion toy comprising:

a toy body, said toy body comprising a hollow trunk, a head pivoted to said trunk at a top side, and two legs respectively pivoted to said trunk at two opposite sides, said legs each comprising a thigh having a top end pivoted to said trunk and a bottom end, a calf having a top end pivoted to the bottom end of said thigh and a bottom end, and a foot pivoted to the bottom end of said calf; and a power drive unit installed in said trunk and controlled in turn the thighs of said legs alternatively back and forth and the calves of said legs alternatively up and down, wherein said trunk of said toy body has a bottom open side covered with a bottom cover.

4. The motion toy of claim 1, wherein said power drive unit comprises a DC motor, a battery box, which provides battery power supply to said motor, and gear transmission means driven by said motor to move said legs.

5. The motion toy of claim 1, wherein said motion toy further comprising a base, which supports the trunk of said toy body, enabling said legs to be moved by said power drive unit relative to said trunk.

6. The motion of claim 1, further comprising a music producing means installed in said trunk and driven to play tunes upon operation of said power drive unit.

7. The motion toy of claim 6, wherein said trunk has a grille on a front side thereof in front of said music producing means.

8. The motion toy of claim 2, wherein said power drive unit comprises a DC motor, a battery box, which provides battery power supply to said motor, and gear transmission means driven by said motor to move said legs.

9. The motion toy of claim 2, wherein said motion toy further comprising a base, which supports the trunk of said toy body, enabling said legs to be moved by said power drive unit relative to said trunk.

10. The motion of claim 2, further comprising a music producing means installed in said trunk and driven to play tunes upon operation of said power drive unit.

11. The motion toy of claim 10, wherein said trunk has a grille on a front side thereof in front of said music producing means.

12. The motion toy of claim 3, wherein said power drive unit comprises a DC motor, a battery box, which provides battery power supply to said motor, and gear transmission means driven by said motor to move said legs.

13. The motion toy of claim 3, wherein said motion toy further comprising a base, which supports the trunk of said toy body, enabling said legs to be moved by said power drive unit relative to said trunk.

14. The motion of claim 3, further comprising a music producing means installed in said trunk and driven to play tunes upon operation of said power drive unit.

15. The motion toy of claim 3, wherein said trunk has a grille on a front side thereof in front of said music producing means.

* * * * *